US011505938B2

(12) United States Patent
Yates

(10) Patent No.: US 11,505,938 B2
(45) Date of Patent: Nov. 22, 2022

(54) FLEXIBLE SPACE FRAME COMPONENTS AND METHOD OF CONSTRUCTION

(71) Applicant: Eric Yates, Honolulu, HI (US)

(72) Inventor: Eric Yates, Honolulu, HI (US)

( * ) Notice: Subject to any disclaimer, the term of this patent is extended or adjusted under 35 U.S.C. 154(b) by 485 days.

(21) Appl. No.: 16/550,391

(22) Filed: Aug. 26, 2019

(65) Prior Publication Data

US 2019/0379665 A1 Dec. 12, 2019
US 2022/0239650 A9 Jul. 28, 2022

Related U.S. Application Data

(62) Division of application No. 15/935,854, filed on Mar. 26, 2018, now Pat. No. 10,494,806.

(51) Int. Cl.
*E04B 1/19* (2006.01)
*E04B 1/28* (2006.01)

(52) U.S. Cl.
CPC ..... *E04B 1/1912* (2013.01); *E04B 1/28* (2013.01); *E04B 2001/1933* (2013.01)

(58) Field of Classification Search
CPC .. E04B 1/1912; E04B 1/28; E04B 2001/1933; E04B 2001/1966; E04B 2001/1978; E04B 2001/1981; E04B 1/19
See application file for complete search history.

(56) References Cited

U.S. PATENT DOCUMENTS 1,410,876 A * 3/1922 Bell ..... B63B 1/24 114/274
4,677,805 A * 7/1987 Schleisner ..... E04B 1/1903 52/655.1
5,097,645 A 3/1992 Sanderson
5,448,868 A * 9/1995 Lalvani ..... E04B 1/3211 52/648.1
6,378,265 B1 * 4/2002 Konstandt ..... E04B 1/1903 403/171
6,739,937 B2 * 5/2004 Snelson ..... A63H 33/10 446/107
7,118,442 B2 * 10/2006 Laliberte ..... A63H 33/06 446/85
7,857,552 B2 * 12/2010 Li ..... E02D 29/025 405/302.4
7,954,296 B2 * 6/2011 Newland ..... E04B 1/19 52/655.1
8,201,294 B1 * 6/2012 Lee ..... E01D 1/00 14/78
8,464,476 B2 * 6/2013 Roberts ..... E04B 1/3211 52/80.1

(Continued)

FOREIGN PATENT DOCUMENTS

DE 2501781 A1 * 7/1976 ..... E01D 15/133

*Primary Examiner* — Rodney Mintz
(74) *Attorney, Agent, or Firm* — William Gray Mitchell

(57) ABSTRACT

A system of cross-shaped units and nodes used to construct strong, lightweight, inexpensive space frames with alternately rigid and flexible components, in which each cross-shaped unit which fits together with five like units to form a spherical node which can be connected to other nodes to form frames for the production of structures including toys, playground structures, lattices, pergolas, statues, roofs, furniture, fixtures, mattresses, kites, lamps, artistic structures and fixtures, floating platforms, flexible joints for machines or robots, buildings, bridges and space stations.

5 Claims, 16 Drawing Sheets

(56) References Cited

U.S. PATENT DOCUMENTS 8,567,149 B2 * 10/2013 Kuzmin ..... A63H 33/08 52/592.1
8,986,809 B2 * 3/2015 Gershenfeld ..... B23P 11/00 428/99
9,566,758 B2 * 2/2017 Cheung ..... B64C 1/06
9,745,736 B2 * 8/2017 Wadley ..... C21D 1/06
9,765,512 B2 * 9/2017 Williams ..... F01D 5/147
9,783,977 B2 * 10/2017 Alqasimi ..... E04B 1/3441
9,809,977 B2 * 11/2017 Carney ..... B64C 1/068
10,156,064 B1 * 12/2018 Novikov ..... E04B 1/1903
10,494,806 B2 * 12/2019 Yates ..... H04L 63/1441
10,710,698 B2 * 7/2020 Carney ..... B23P 19/04
2002/0081936 A1 * 6/2002 Snelson ..... A63H 33/10 446/111
2002/0123293 A1 * 9/2002 Snelson ..... A63H 33/10 446/85
2004/0247866 A1 * 12/2004 Jensen ..... D04C 3/48 428/364
2005/0210767 A1 * 9/2005 DeFever ..... E04B 1/169 52/80.1
2008/0040984 A1 * 2/2008 Lanahan ..... E02B 3/04 52/79.9
2008/0066393 A1 * 3/2008 Sorensen ..... A63H 33/101 52/81.1
2010/0236184 A1 * 9/2010 Newland ..... E04B 1/19 52/653.1
2012/0094060 A1 * 4/2012 Gershenfeld ..... B64C 3/48 428/99
2013/0302172 A1 * 11/2013 Williams ..... B29D 99/0007 156/60
2014/0037873 A1 * 2/2014 Cheung ..... B64C 1/06 428/34.1
2016/0208476 A1 * 7/2016 Wadley ..... C22C 38/40
2017/0020282 A1 * 1/2017 Bensen ..... E04B 1/5831
2017/0043883 A1 * 2/2017 Carney ..... B29C 64/106
2017/0145681 A1 * 5/2017 Alqasimi ..... E04B 1/3441
2017/0145694 A1 * 5/2017 Carney ..... B23P 19/04
2017/0152658 A1 * 6/2017 Schaefer ..... B64C 1/061
2017/0183870 A1 * 6/2017 Cheung ..... E04B 1/1903
2019/0024362 A1 * 1/2019 Pfeiffer ..... E04B 1/2403
2019/0284792 A1 * 9/2019 Lopez Blanco ..... F16B 9/05
2019/0292768 A1 * 9/2019 Yates ..... E04B 1/28
2020/0113140 A1 * 4/2020 Scott ..... E04B 1/40

* cited by examiner

FLEXIBLE SPACE FRAME COMPONENTS AND METHOD OF CONSTRUCTION

CROSS REFERENCE TO RELATED APPLICATIONS

This patent application claims priority to U.S. patent application Ser. No. 15/935,854, filed Mar. 26, 2018.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relates to a flexible space frame, the components thereof and a method of construction.

Background of the Invention

The present invention is a light, strong and flexible space frame and a versatile method for construction of such a frame.

Modular framing systems applied to aerospace vehicles and structures, as well as to terrestrial construction and robotics, are known. For example, U.S. Pat. No. 1,410,876 to Bell teaches kite-shaped tetrahedral structures to be interlocked for an aerial vehicle or structure. More recently, U.S. Pat. No. 5,097,645 to Sanderson.

Space frames are useful in that they provide a construction method that is atypical of rectilinear frame construction of many typical buildings and structures. Space frames provide a light weight easy to construct structure which is aesthetically pleasing and multifunctional. They are often used for roof top frames, pergolas, and venues which want to portray a cosmopolitan or space age ambiance.

Currently known space frame models require the use of specially designed struts made of metallic alloys which are rigid and thus do not allow for a freedom of movement within the assembled frame in reaction to airflow or other stresses. These frame components are often also comprised of expensive metals and pose difficulties in distribution that lead to logistical challenges and increased expense.

As is well known in the fields of civil and industrial engineering, the overuse of rigid materials makes the resulting products, whether buildings, vehicles or machines, susceptible to fractures and failure when environmental stress is applied, whether from wind, water, torsion, acceleration or otherwise. The degree and location of flexibility within a structure is determined by the architect and/or engineer. In modular construction, the best practice is to provide the designer with choices as to which points within the larger design may be either flexible or rigid, allowing for a structure that can best respond to anticipated types environmental stress. For example, a given structure can remain rigid when force is applied from one direction, but flexible when force is applied from a different, or even opposite, direction.

Currently known space frame technology lacks a combination of rigid and flexible components whereby a force applied to a rigid component can be transferred to flexible components to be distributed evenly throughout the structure. The invention as taught herein addresses this lack of flexibility.

BRIEF SUMMARY OF THE INVENTION

In a preferred embodiment, a cross-shaped member for constructing a space frame, such member comprising a cross-piece with four equidistant arms, each extending outward towards a distal end, each end comprising an integrated connector piece designed to interlock with other connector pieces, each such connector piece comprising a distal connecting pin with a ledge and an angled edge for locking, a distal connecting hole, a short side alignment pin, a short side alignment hole, a tall side alignment pin, a tall side alignment hole a channel and a semicircular protrusion, wherein each pair of connector pieces interlock using the side alignment pins and side alignment holes to form a connector piece assembly with two distal connecting pins and two distal connecting holes.

In another preferred embodiment, the cross-shaped member as described herein, wherein the cross-shaped member is constructed of a durable yet flexible material from the group comprising shape memory metal alloys, shape memory polymers or shape memory copolymers.

In another preferred embodiment, the cross-shaped member as described herein, comprising a cross piece and four arms made from the group consisting of shape memory alloys, shape memory polymers or shape memory copolymers, and four connector pieces made of a non-shape memory metal alloy or polymer.

In another preferred embodiment, the cross-shaped member as described herein, wherein the cross-shaped member is made of injection-molded plastic.

In another preferred embodiment, the cross-shaped member as described herein, wherein the cross-shaped member is manufactured by three-dimensional printing.

In another preferred embodiment, the cross-shaped member as described herein, wherein the connector pieces interlock using only applied pressure to snap together.

In another preferred embodiment, a space frame comprising a plurality of frame units wherein each such unit is connected by a snap fit connection between the units' respective connector piece assemblies, such units taken from the group consisting of: (i) a spherical unit comprised of six cross-shaped members as described herein, wherein each connector piece is interlocked with another connector piece to form twelve total connector piece assemblies and six convex surfaces, wherein each pair of connector pieces interlocks using the distal connecting pins and distal connecting holes to form a connector piece assembly with two tall side pins, two short side pins, two tall side holes and two short side holes; and (ii) a reverse unit wherein each cross-shaped member is inverted, yielding six concave surfaces, wherein each pair of connector pieces interlocks by inserting the side alignment pins into the corresponding side alignment holes to form twelve connector piece assemblies, each connector piece assembly locked with two overlocking blocks and comprising two distal connecting pins and two distal connecting holes.

In another preferred embodiment, the space frame as described herein, comprising a plurality of tetrahedral units, with a spherical unit arranged inside of each tetrahedral unit.

In another preferred embodiment, the space frame as described herein, comprising a plurality of octahedral units, with a spherical unit arranged inside of each octahedral unit.

In another embodiment, a method of manufacturing the space frame as described herein, comprising the steps of: (1) making the cross-shaped members by fashioning each cross piece and four arms from the group consisting of shape memory alloys, shape memory polymers or shape memory copolymers, and four connector pieces made of a non-shape memory metal alloy or polymer; (2) creating frame units taken from the group consisting of: (i) a spherical unit comprised of six cross-shaped members, wherein each connector piece is interlocked with another connector piece to form twelve total connector piece assemblies and six convex surfaces, wherein each pair of connector pieces interlocks using the distal connecting pins and distal connecting holes to form a connector piece assembly with two tall side pins, two short side pins, two tall side holes and two short side holes (ii) a reverse unit wherein each cross-shaped member is inverted, yielding six concave surfaces, wherein each pair of connector pieces interlocks by inserting the side alignment pins into the corresponding side alignment holes to form twelve connector piece assemblies, each connector piece assembly with two distal connecting pins and two distal connecting holes, and finally interlocking the connector pieces with the snap-fit overlay of two overlocking blocks, and (3) connecting each such unit to one or more other units by a snap fit connection between the units' respective connector piece assemblies.

In another preferred embodiment, a node for constructing a space frame, such node comprising two or more helical cross-shaped members, each such member with four arms, wherein each such member comprises one or more grooves allowing two or more such members to be reversibly interlocked at an interface joint and each arm comprises a c-channel cut along the axis, each arm thus accommodating a rod for connecting the node to other nodes.

In another preferred embodiment, the node as described herein, comprising three cross-shaped members with twelve total arms and thereby twelve points of attachment to other nodes.

In another preferred embodiment, the node as described herein, whereby each cross-shaped member is made from the group consisting of shape memory alloys, shape memory polymers or shape memory copolymers.

In another preferred embodiment, the node as described herein, whereby each cross-shaped member is permanently attached using melting, adhesives or similar bonding.

DETAILED DESCRIPTION OF THE INVENTION

The invention comprises a modular space frame with multiple rigid components tied together using a flexible frame, wherein the flexible structure maintains its strength along the same lines of strength as the rigid structures. A force applied along a vector through the rigid frame will be transferred into the flexible frame and distributed evenly across the flexible frame.

Levels of flexibility and rigidity within the frame can be varied, either by choice of materials or the thickness thereof. Not only can the flexible frame provided act as a hinge or joint, but it can also act as a cushion or shock absorber between two or more rigid components.

Figure 1:
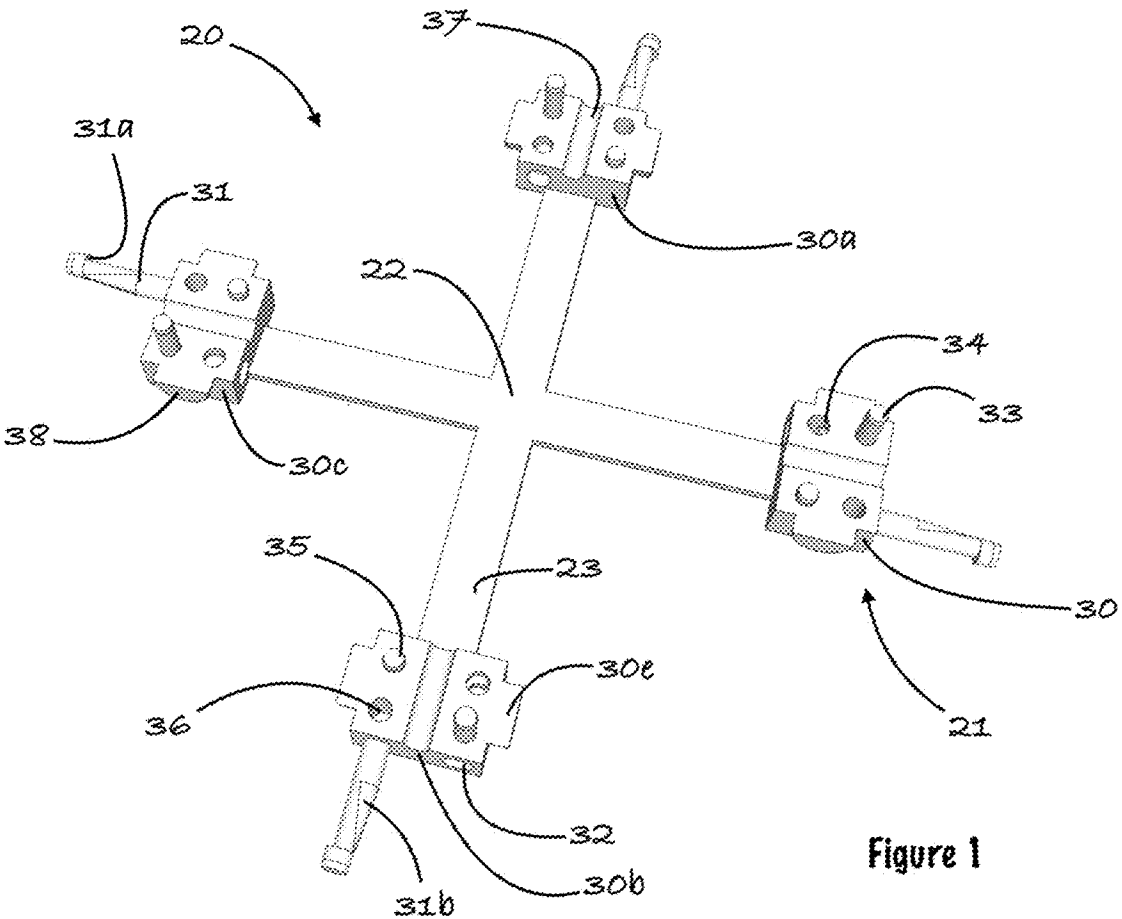
FIG. 1 is a line drawing evidencing a cross-shaped member with connector pieces at each end. The flattened portions make up the struts of the final structure. The ends of the member are used to connect to another cross-shaped members or other fittings designed for a variety of uses. This cross-shaped member can be manufactured by a plastic injection mold or by 3D printing.

This method of flexible space-frame construction allows for the use of a single modular part to construct an entire frame, one embodiment of which is pictured in FIG. 1. This method employs the use of one part repeated many times to produce a structure which is strong, lightweight and flexible. The method of construction for this frame is by means of snap fit parts. For example, six identical cross-shaped members can form one sphere-shaped grouping. The frame can be constructed without the use of glue, weld joints, non-integrated pins, screws or other permanent or non permanent fasteners. That said, the use of any such fastening mechanisms is available to achieve an increased level of adhesive strength, as required.

Each cross-shaped member snaps in place to other like members by fitting the two connector piece assembly components together. As used in describing the invention, "pins" shall be understood to be protrusions, usually cylindrical, integrated into the larger structure of a cross-shaped member for the purpose of attaching to other such members. The connecting pins of one member align to the holes of the other. The two are then squeezed together and either (1) align the larger components for attachment by a secondary mechanism, such as part 70 pictured in FIG. 6, or (2) snap into place once fully inserted.

Six such cross-shaped members can be aligned, bent and connected into a plurality of designs, each comprising a "unit". Examples of such unit designs are a rough spherical unit 50 with six convex surfaces, a reverse unit 51 with six concave surfaces, an open-topped spherical unit 52.

In the spherical unit example, two spheres can be aligned at any of twelve connector piece assemblies 39, located at intervals around the sphere. These alignment points allow the two spheres to be attached together. By again aligning the pins and the holes, the two units can be brought together. The two spheres can be secured in place by attaching overlocking construction blocks 70 at the point of intersection (see, FIG. 7). The same means of attachment are available to the other unit designs, and more units can then be added to build large strong structures of any desired configuration. A fully-constructed frame may utilize only a single unit design, or may incorporate two or more such designs. The resulting frame structure can remain flexible while simultaneously allowing for connector rods to be added and secured in various methods to add high rigidity to specific areas within flexible structure.

Figure 10:
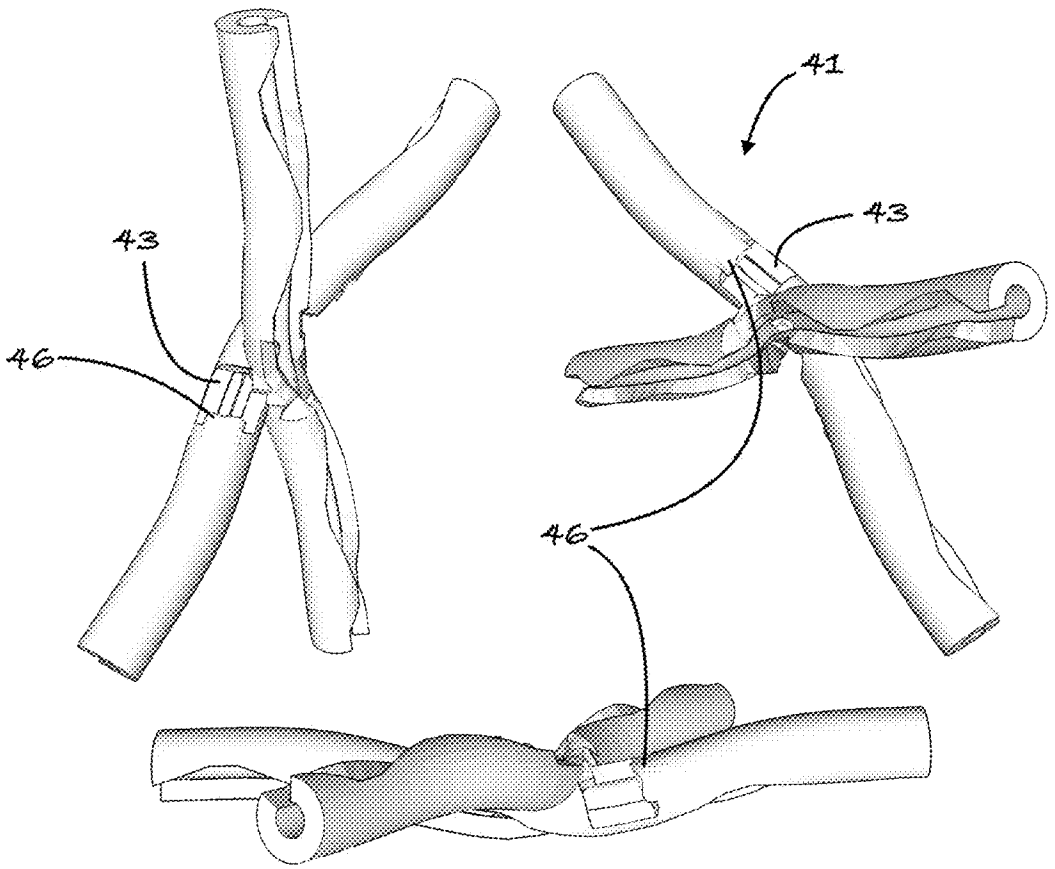
FIG. 10 is a line drawing evidencing an exploded view of a helically curved c-channel node. Each of the three parts are identical triplets and each have the necessary integral parts to align and snap into two additional like units.

This method of space frame construction employs a rigid method of space frame construction in conjunction with and attaches to the flexible frame as described herein above. The disclosed method employs the use of one part repeated many times to produce a structure which is strong, lightweight and rigid. Another cross-shaped member that is different from that used above is used for the manufacture of a 12-pointed (6 channel) star shaped node. In this case, three cross-shaped members, all of the same shape and size, are joined to form one 12-pointed star shaped node. This star shaped node is then used in conjunction with wooden, plastic, metal and/or carbon fiber rods to form up a rigid space frame by the use of snap-fit mechanisms which are integrated into the design. This rigid frame can optionally be constructed without the use of glue, weld joints, non-integrated pins, screws or other permanent fasteners. Each cross-shaped member is made up of two c-channels. The c-channels are designed to allow flexible or semi-flexible rods to be snapped into or inserted from the end into the channel. Typical materials of the flexible or semi-flexible rods would be made up of wood, plastic, metal, fiberglass or carbon fiber, or other, similar materials exhibiting a varied degree of rigidity and durability while also allowing for flexibility. Materials for the flexible or semi-flexible rods will be chosen and/or mixed to account for the degree of flexibility desired and the level of stress expected on a given construction. The purpose of the node, for example as pictured in FIG. 10, is to allow a user to weave semi-flexible rods into a space frame. Friction holds the rods in place and keeps them from slipping axially, while forming a rigid space frame that is then used either by itself or in conjunction with the other frames as described herein.

Applicant's disclosed manufacturing method prevents the need for a complicated mold and manufacturing processes which can add costs to the end product. Since the final product results in a 12-sided shape, an injection-molding or similar process would require a 12-sided mold and a specialized and complex manufacturing process. Thus, a cost-effective manufacturing process as described herein will have great market utility.

The disclosed method offers simplicity such that unskilled workers will be able to install and assemble the frame quickly and easily. There are few if any tools required for assembly when the units are relatively small in size. As such, units up to a certain size can be assembled without tools, welding or adhesives, and disassembly is similarly simple with few or no tools needed.

Shape memory metal alloys (SMAs) and shape memory polymers (SMPs) are known that would provide the desired flexibility to components of the space frame invention, preferably the cross pieces and/or arms of the cross-shaped members. SMAs such as nickel-titanium, nickel-aluminum, copper-aluminum-nickel, beta titanium alloys such as Ti—Nb, Ti—Mo or Ti—V, beta brass alloys such as Cu—Zn—Al, are currently in use in the industries of medical devices, robotics, industrial design and, increasingly, construction. Flexible space frame components made of SMAs could exhibit either one-way or two-way memory effects. In the latter case, the components could be stored and transported at one temperature with a shape providing for ease of storage and movement, with such components then displaying a different, second shape when deployed at a second temperature, such as the extreme cold of outer space.

Several known polymer and copolymer types exhibit shape memory properties and may be useful for producing cross-shaped members. Probably the best known and best researched SMP is polyurethane polymer, but also known are crosslinked polyethylene homopolymer, styrene-butadiene thermoplastic copolymer, polyisoprene, the class of copolymers including stearyl acrylate and acrylic acid or methyl acrylate, as well as norbornene or dimethaneoctahydronapthalene homopolymers or copolymers, and styrene copolymer.

SMPs and SMAs have been the subject of commercial development in the last 20 years. SMPs derive their name from their inherent ability to return to their original "memorized" shape after undergoing a shape deformation. In the present invention, the use of an SMA or SMP to manufacture the belt-like configurations of cross-shaped members will allow those members to bend, twist or otherwise deform within their unit structures to absorb an application of force that might otherwise damage or destroy the larger frame, but then return to their original configurations to maintain the frame integrity after any such shock occurs.

Construction of Applicant's frame components may occur by use of injection molding, three-dimensional printing, or similar techniques used commercially for metals and plastics.

The final structure can have an infinite arrangement and therefore allow for the final structure to have a plurality of shapes.

One embodiment is a structure is based on a face centered cubic lattice of spheres and a tetrahedral-octahedral honeycomb of straight lattices and an arrangement with the diameter of each node being equal, it forms a space filling arrangement of spheres interconnected with a lattice of tetrahedral-octahedral honeycombs, which can be manufactured with the use of three-dimensional printing techniques. (See, e.g., FIGS. 12 and 14). The final structure can fill free space without running into itself. It is possible to join two adjacent rigid space frames of the similar tetrahedral-octahedral honeycomb design together with a flexible frame. These two rigid frames would then have the advantage of being joined while at the same time move or sway independently. For example, this could be used when joining two floating rigid structures. Finally, two rigid structures could be joined and allowed to shift independently while remaining joined.

The ease of tool-free assembly means that frame structures may be constructed on-site without the need for large-scale prefabrication, even in difficult environments. This will allow the frames to remain in modular form during transportation, where they can be usefully stacked and stowed. Similarly, the units of the frame may be disassembled by unsnapping, requiring few or no tools. Thus, the ease of maintenance of a frame-on site will be enhanced, as single units may be removed and replaced and entire frames reconfigured with minimal difficulty.

The ease of construction and reconfiguration of a frame structure provides capability to change the frame shape or to change units of one material or type with units of another as needed.

In order to prevent the units of the larger frame from pulling apart, shape memory materials will sometimes be inappropriate for manufacture of the connector pieces. In another embodiment, the connector pieces will be made of a known hard alloy, ceramic, polymer or copolymer, and connected to each arm end via a known process of integration such as via adhesive, welding or similar stress-resistant method of attachment.

If either nitinol or piezoelectric crystals are introduced along one direction of the final structure then the structure can bend with a change in temperature or electrical current. This feature can provide a multitude of applications ranging from lifts, and joints to large mechanical muscles. It is preferred to use piezoelectric crystals within the matrix as a means to introduce mechanical control of the matrix. Piezoelectric crystals are known and used in industry because of their unique capability to change shape, deform, warp, shrink or expand when an electric current is applied. This property of the crystals is not only useful for the purpose of changing shape, in addition the crystals apparently exhibit intense force comparable for their size and weight. So a small crystal can lift several times its own weight without permanent degradation of its structure. On the downside, these crystals have limited movement and shape deformation characteristics which limit their usefulness as mechanical muscles in. However, they have found their way into many other technologies. Presently, they are used in printers, copiers, telecommunications, pneumatics and a variety of other technologies. The present invention introduces a new application for these crystals which will allow their use in mechanical muscles.

The invention can produce a large flexible frame with the use of "sites" throughout its structure. A site is created at any point where flexibility can be observed and where a piezoelectric crystal can be attached between two points. Piezoelectric crystals can optionally be introduced per the designer's requirements. When introduced into the structure, the piezoelectric crystals are attached and secured to the structure. Wires connect the crystals to a power source and a control center wherein electricity can be introduced to the crystals at those locations to where movement is needed. The powered piezoelectric crystal will then pull or push on the frame to initiate a bending, twisting, shrinking or expansion of the entire frame. The resulting structure will have the ability to lift or move a significant amount of mass without the need for complicated and heavy hydraulics, pneumatics, gears, shifters, relays, motors and shafts. Furthermore, the sensitive crystal is protected by the flexible cushioning nature of the frame, so a crystal will not be at significant risk of damage from over applied force.

The resulting frame will now have the properties of being lightweight, flexible, maneuverable, easily constructed, and finally the ability to act as a mechanical muscle. Additionally, because we can introduce rigidity into any part of the frame as we desire the frame can also have the property of being a simulated bone. So, the resultant structure will have system of mechanical muscles along with rigid skeletal system and the ability to attach the two systems together, allowing the complete structure to perform similarly to that of an integrated musculoskeletal system with all the properties thereof.

Electrical power sources for piezoelectric crystals may be taken from known commercial technology, notably alkaline batteries, lithium ion or other known chemical batteries, solar panels or any other known power source that can be sized and mounted appropriately on the frame.

A space frame for use in a space-station could be used as means of storage while at the same time providing protection from the elements of space. For instance, a flexible frame which has the natural shape of a sphere could provide a means of holding an array of spherical tanks, providing compartmentalization similar to that used in large oceangoing vessels. If this array is used to hold water, fuel, and food then the extra mass added to the frame would help protect the space station from the impact of a small meteor or perhaps radiation. If damage did occur it would be localized to a small region which could easily be repaired. Losses would be minor as the lost cargo would be limited to the vessels which were hit while the remaining vessels remain intact. A similar incident to a larger tank would result in a complete loss of the contents of the entire vessel.

The invention as described herein contrasts from known frame technology in that is exhibits a high degree of flexibility along axial lines. For example, the disclosed units will deform to absorb the stress of a force applied axially along one of the connector rods or radially across the frame, before reverting to its original configuration due to its shape memory components. Further, the method of construction differs from known technology in that the cross-shaped members bend like a spring and are attached together at the tips, whereas known designs require slots cut into the base, fasteners like pins, bolts or screws, or similar means of attachment. As such, this frame allows the units of any configuration to be joined directly to each other without the need for connection rods, pins or other separate connecting components. The inherent flexibility of the larger frame will also compensate for any minor misalignments or defects in the components themselves.

Applicant's frame flexibility also allows for the frame to bend while being assembled, further adding to ease of construction. Because this frame utilizes one repeat unit that can be made rapidly, with known techniques, and units can be stowed efficiently and assembled on site, the frame is less costly to manufacture, distribute, assemble and maintain. Additional pieces would require more molds, additional packaging and increase end costs.

DETAILED DESCRIPTION OF THE FIGURES

FIG. 1 is a drawing of the ventral side of a cross-shaped member 20 with a cross piece 21 in the center with four equidistant arms 23, each extending outward towards a connector piece 30, located at each of four arm ends 21. Each connector piece is roughly rectangular, with a proximal surface 30*a* and distal surface 30*b*, two side surfaces 30*c*, as well as dorsal face 30*d* (obscured) and a ventral face 30*e*. Each arm ends 21 is used to connect to another cross-shaped member 20 or other fittings designed for a variety of uses. Each connector piece 30 is raised above its corresponding arm 23 in the ventral direction, and each comprises a distal connecting pin 31 extending from the distal surface 30*b* of the connector piece and a distal connecting hole 32 for receiving the distal connecting pin of another connector piece, with such distal connecting pin 31 comprising a ledge 31*a* and an angled edge 31*b* for connecting to another connector piece by snap-fit. Each connector piece also comprises a pair of complementary pins and holes consisting of tall and short side alignment pins, 33 and 35, respectively, and tall and short side alignment holes, 36 and 34, respectively, arranged on the ventral face 30*e* also for alignment of the connector pieces, as well as a channel 37, semicircular protrusion on each side surface side. The cross-shaped member 20 can be manufactured by a plastic injection mold or by 3D printing.

Figure 2:
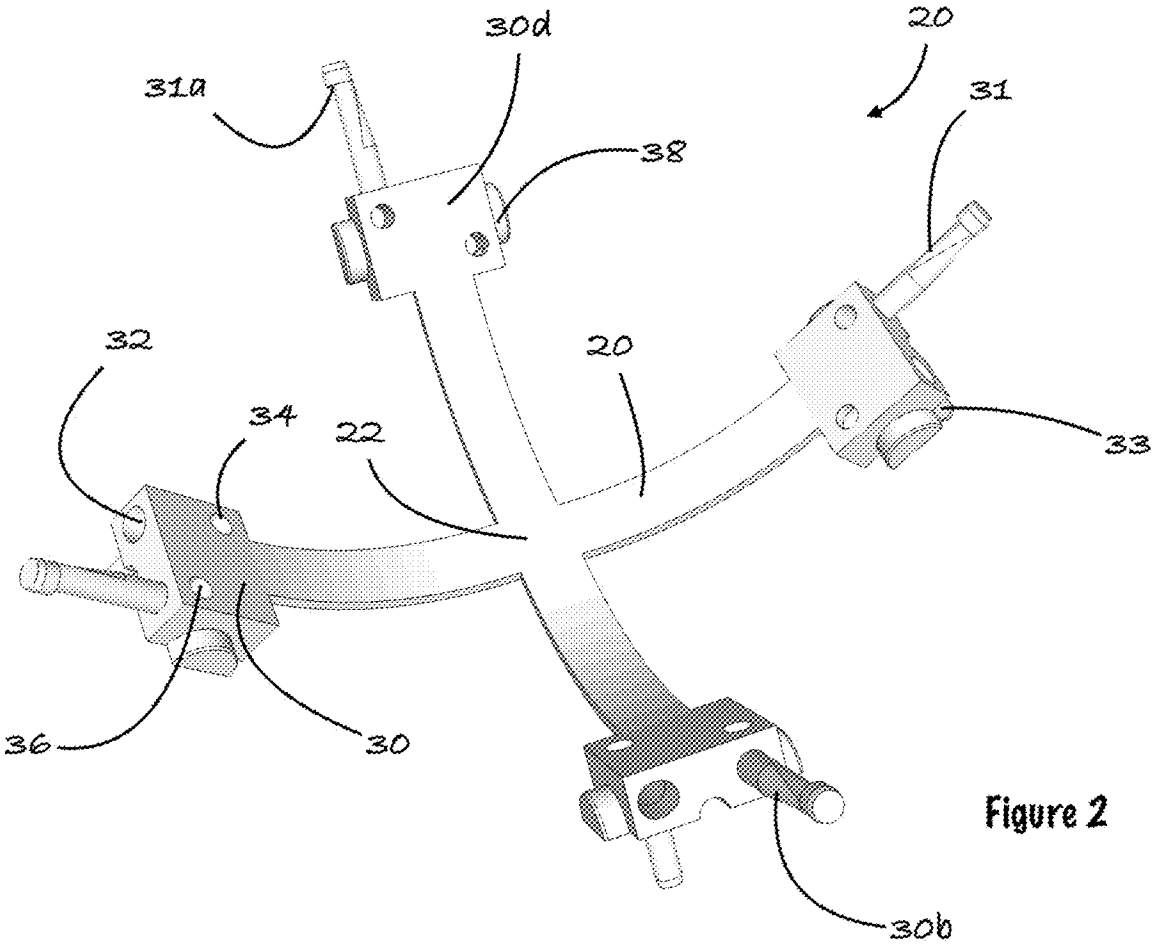
FIG. 2 is a line drawing evidencing an alternate formation the cross-shaped member of FIG. 1 in which the member is flipped over and bent.

FIG. 2 shows a cross-shaped member of the dorsal side of the cross-shaped member 20 pictured in FIG. 1. In particular, the dorsal face 30*d* of each connector piece 30 is pictured, evidencing the opening in such dorsal face of each of the short and tall side alignment holes, 34 and 36, respectively.

Figure 3:
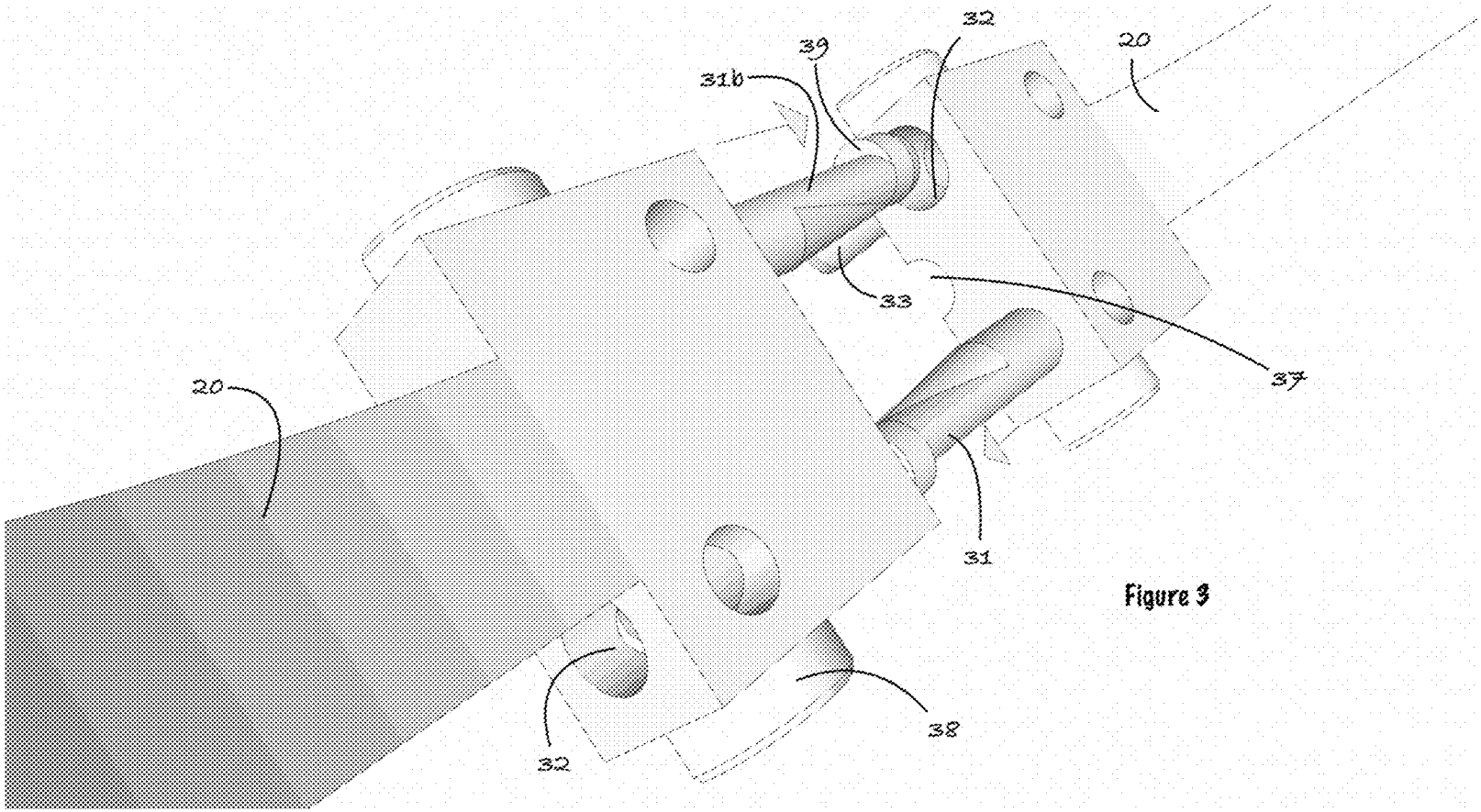
FIG. 3 is a line drawing evidencing the interlocking design of the connector pieces of two cross-shaped members.

FIG. 3 shows two connector pieces 30 initiating a snap-fit connection whereby each connector piece's distal connecting pin 31 is being inserted into the opposite connector piece's distal connecting hole.

Figure 4:
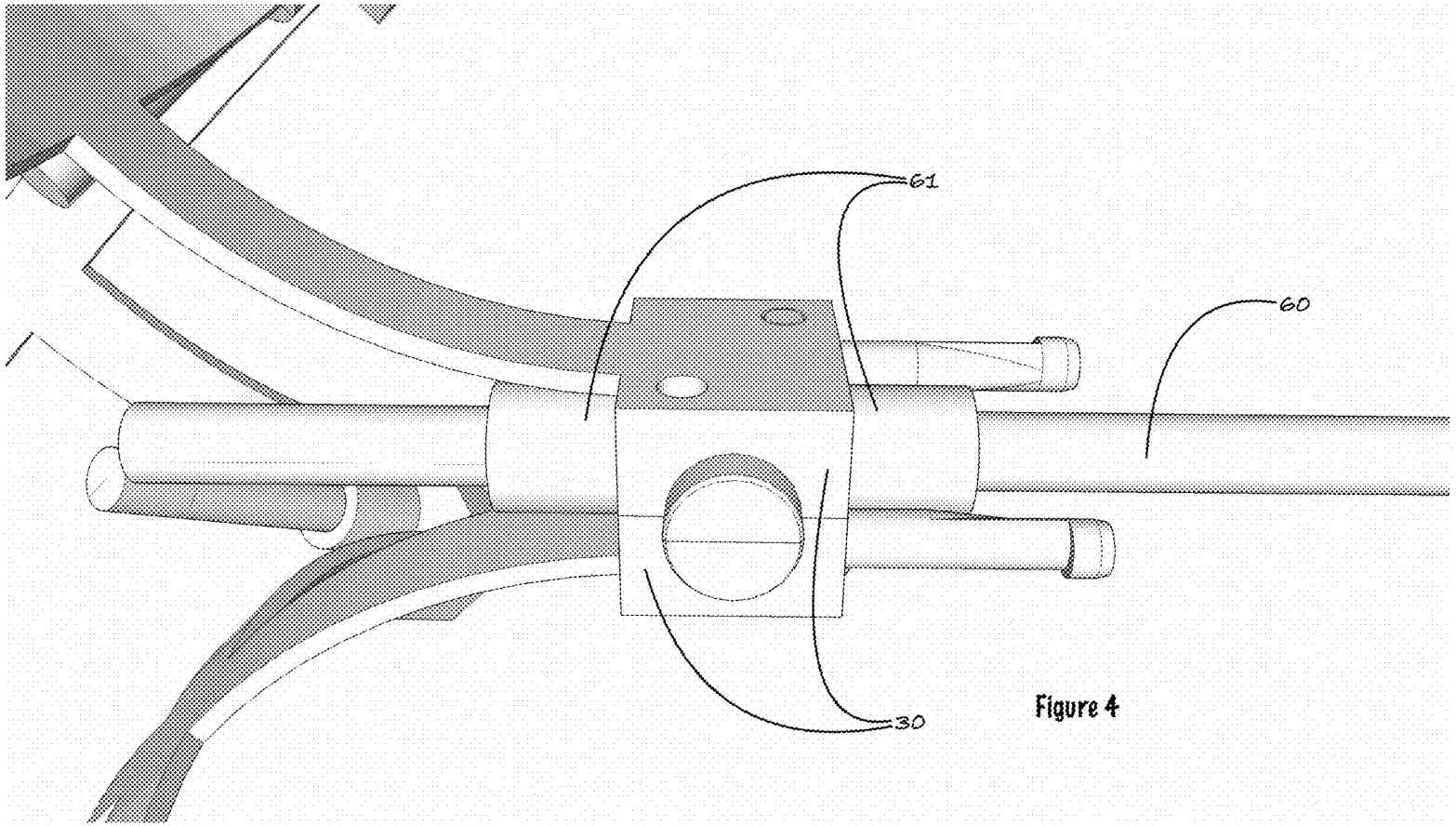
FIG. 4 is a line drawing evidencing two aligned connector pieces further comprising two optional single barrel crimping sleeves 61 clamping on a connector rod.

FIG. 4 shows two connector pieces 30 with a two single barrel crimping sleeves 61 emanating from each side, and a connector rod 60 inserted through crimping sleeve holes not pictured). The collet mechanism is fully pictured in FIG. 10. In an alternate embodiment, adhesives, heat shrinking or welding could be used instead of crimping sleeves. Crimping sleeves are not absolutely necessary unless positive control between flexible and rigid frame connection is required. For instance, if the connection point is between two floating platforms, then the designer may use crimping sleeves to allow for freedom of movement at the joints.

Figure 5A:
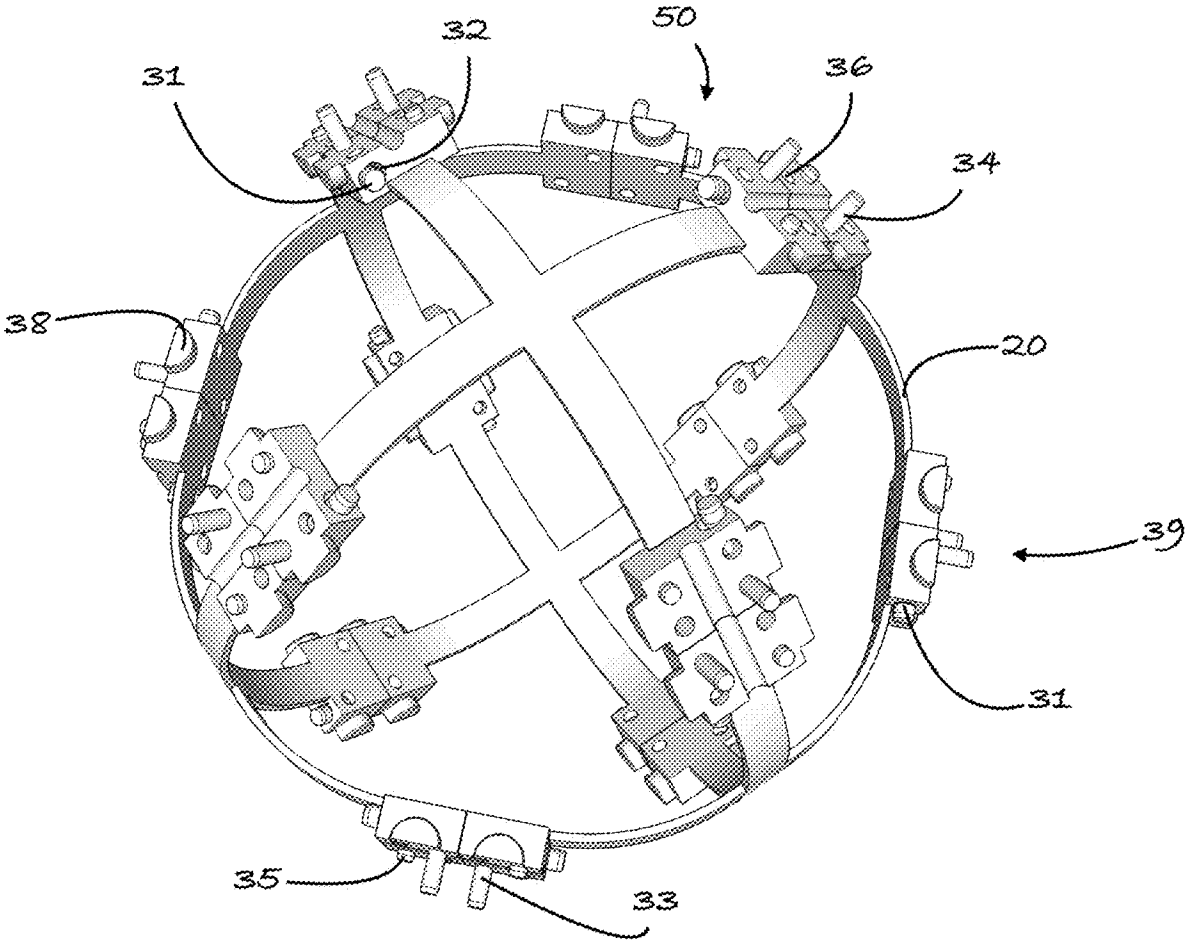
FIG. 5A is a line drawing evidencing six cross-shaped members locked together to form a spherical unit.

FIG. 5A shows a fully-formed spherical unit 50, comprising six cross-shaped members 20 wherein each such member connects to four other cross-shaped members using the distal connecting pins 31 and distal connecting holes 32 on its four connector pieces 30, thereby creating six convex cross-shaped surfaces, which together roughly approximate a sphere. In this configuration, the ventral faces 30*e* of each connector piece are facing outward while the dorsal faces 30*d* are facing inward. In this configuration, twelve connector piece assemblies 39 are formed, each comprising two connector pieces 30, with the short and tall connecting pins 33, 35 and short and tall connecting holes 34,36 located on each connector piece's ventral face 30*e* are left facing outward. This design allows the further connection of the spherical unit 50 with other units.

Figure 5B:
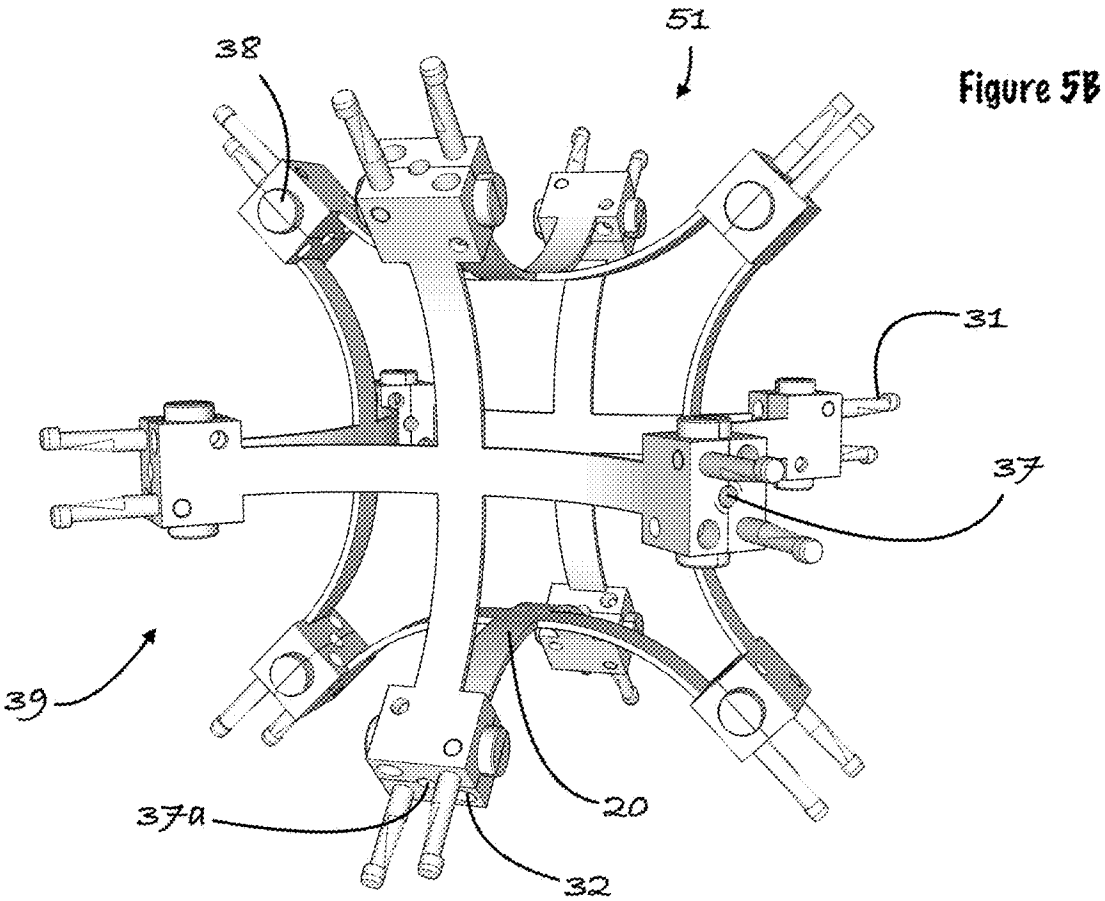
FIG. 5B is a line drawing evidencing multiple cross-shaped members locked together to form an alternate reverse unit, also comprised of six cross-shaped members.

FIG. 5B shows an alternate configuration to the spherical unit of FIG. 4A, in which the six cross-shaped members' 20 connector pieces 30 are interlocked using the short and tall connecting pins 33,35 and short and tall connecting holes 34,36 located on each connector piece's ventral face 30*e* (all such connecting parts obscured). The resulting reverse unit 51 comprises six cross-shaped concave surfaces, together forming a starburst-shaped formation with twelve connector piece assemblies 39 forming points, each comprising two interlocking connector pieces 30 and featuring two outward-facing distal connecting pins 31 and distal connecting holes 32, enabling the further connection of the reverse unit 51 with other units.

Figure 6:
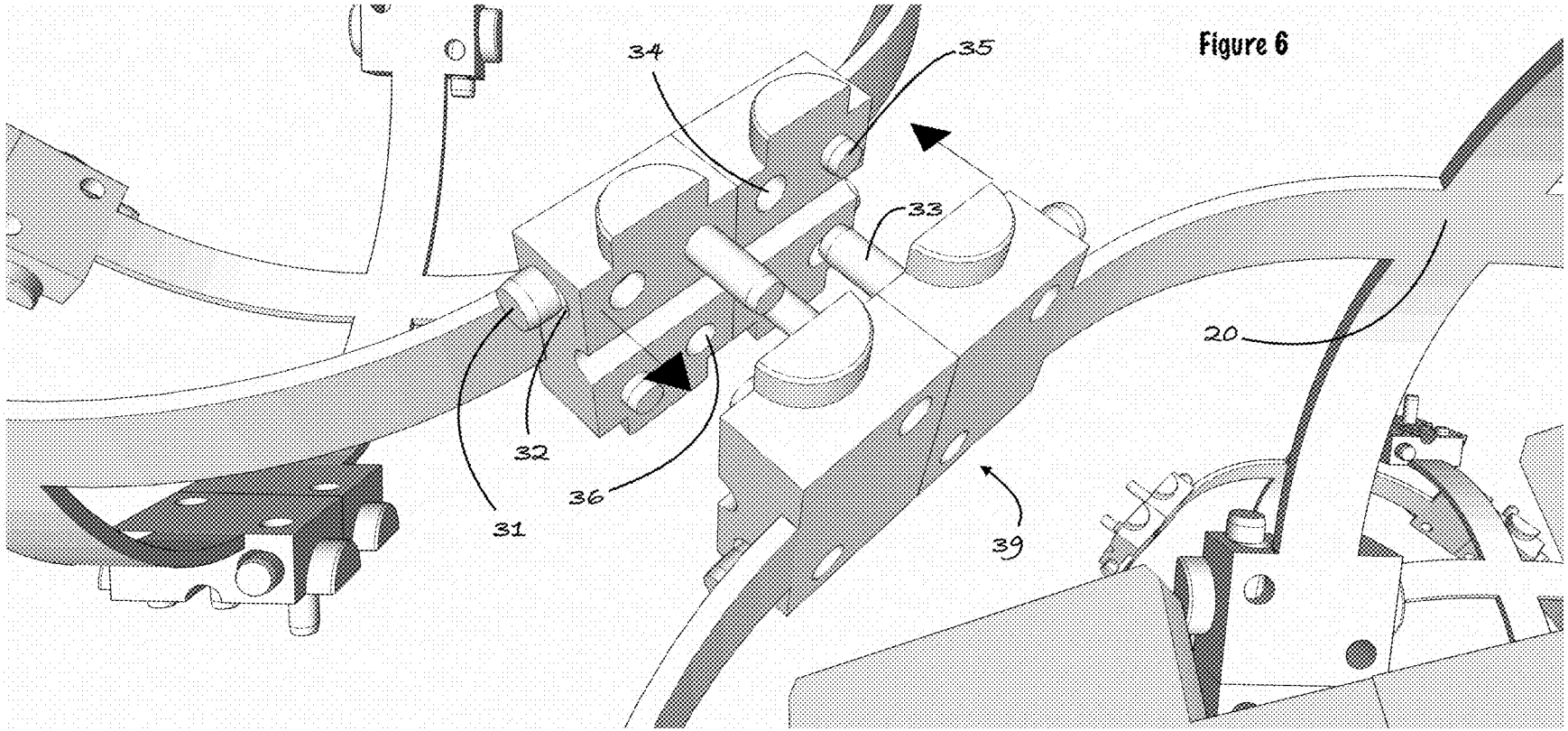
FIG. 6 is a line drawing evidencing the interlocking connector pieces of two spherical units.

FIG. 6 provides a close-up view of the connector piece assemblies 39 of two separate spherical units 50 as they approach to interlock, with arrows indicating the interlocking snap fit of each connector piece assembly's short and tall connecting holes 34,36 with the corresponding short and tall connecting pins 33,35 of the opposite connector piece assembly. The listed pins and holes provide alignment of the connector piece assemblies, which are then locked together using overlocking blocks 70, as pictured in FIG. 7, for example.

Figure 7:
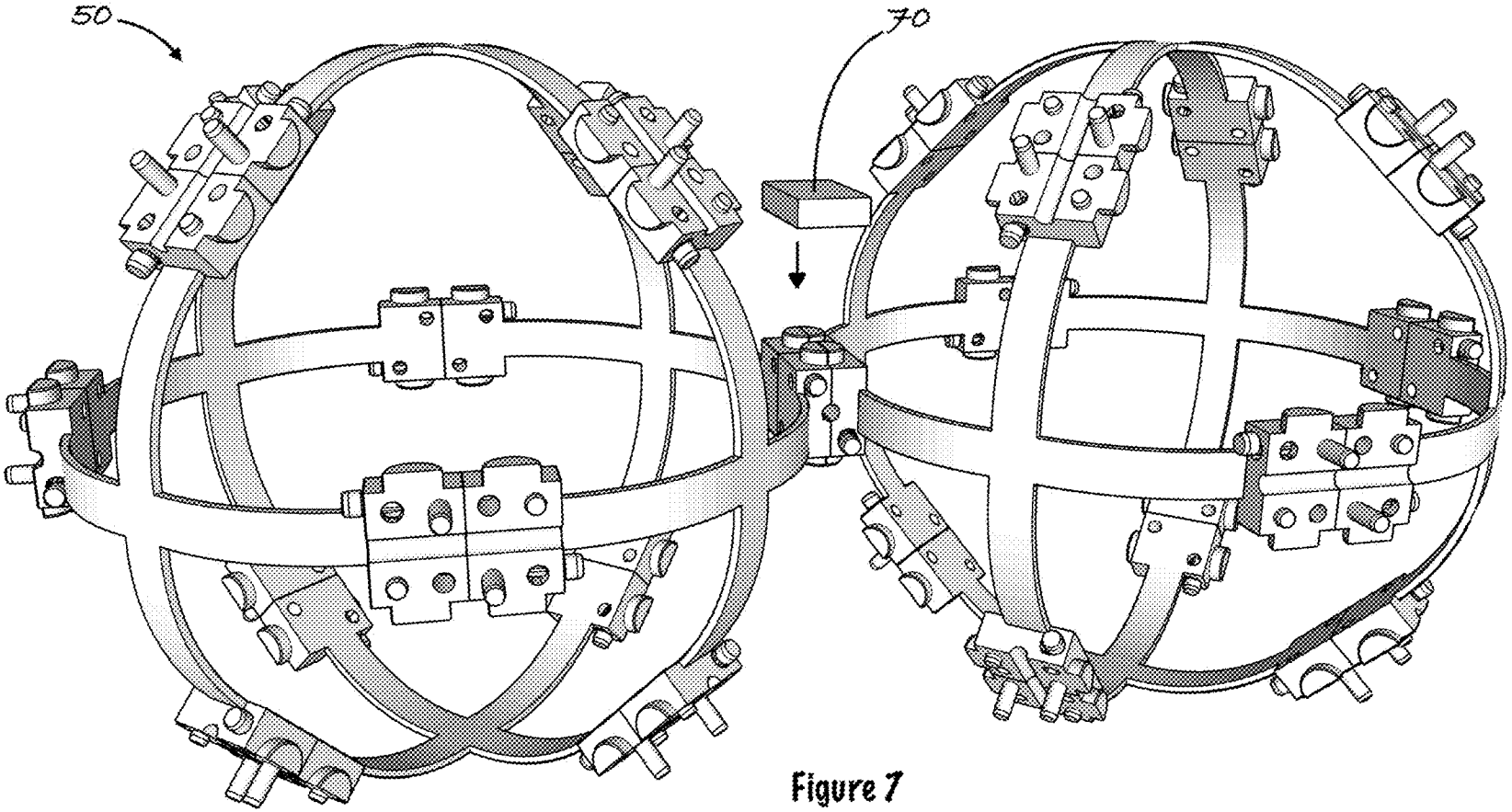
FIG. 7 is a line drawing evidencing two spherical units jointed at one connector piece assembly.

FIG. 7 shows two spherical units 50 connected by the process pictured in FIG. 5.

Figure 8:
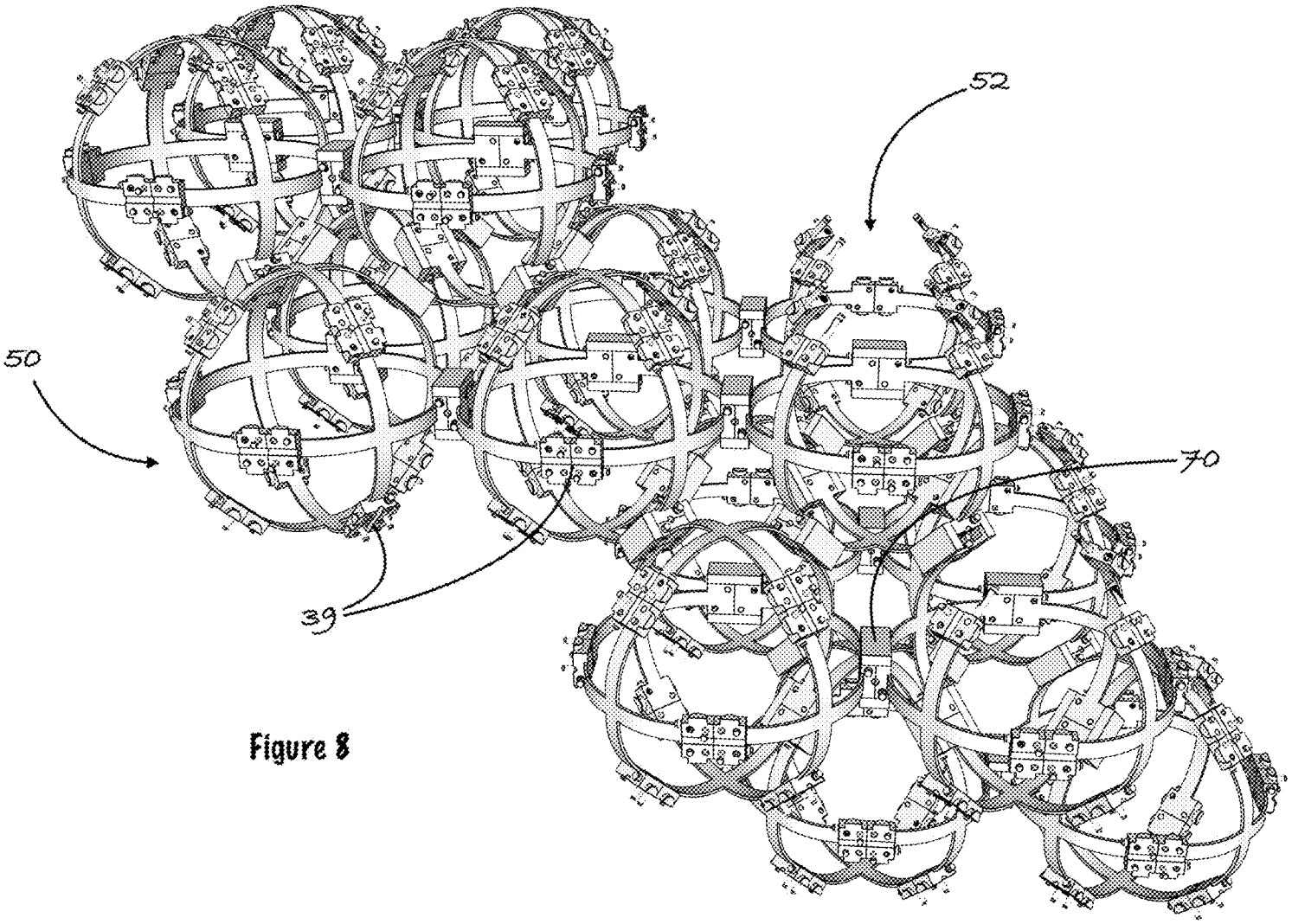
FIG. 8 is a line drawing evidencing a frame comprised of multiple interlocked spherical units, such units in an alternate embodiment whereby one cross-shaped member of several units are is missing to form an open top, with the open top of each such unit facing the same direction.

FIG. 8 shows an alternate frame embodiment wherein a plurality of spherical units 50 are connected to other partially formed, open-toped spherical units 52. Open-topped spherical units 52 are formed from five cross-piece members 20 instead of six, with one cross-piece member 20 being left out of an open-topped spherical unit, each such cross-piece member remains unsecured within the unit itself, thus leaving an open top 52*a*. As pictured, multiple open-topped spherical units are interconnected using the snap fit design of their respective connector piece assemblies 39, which connector piece assemblies are fixed in place using overlocking blocks 70.

Figure 9:
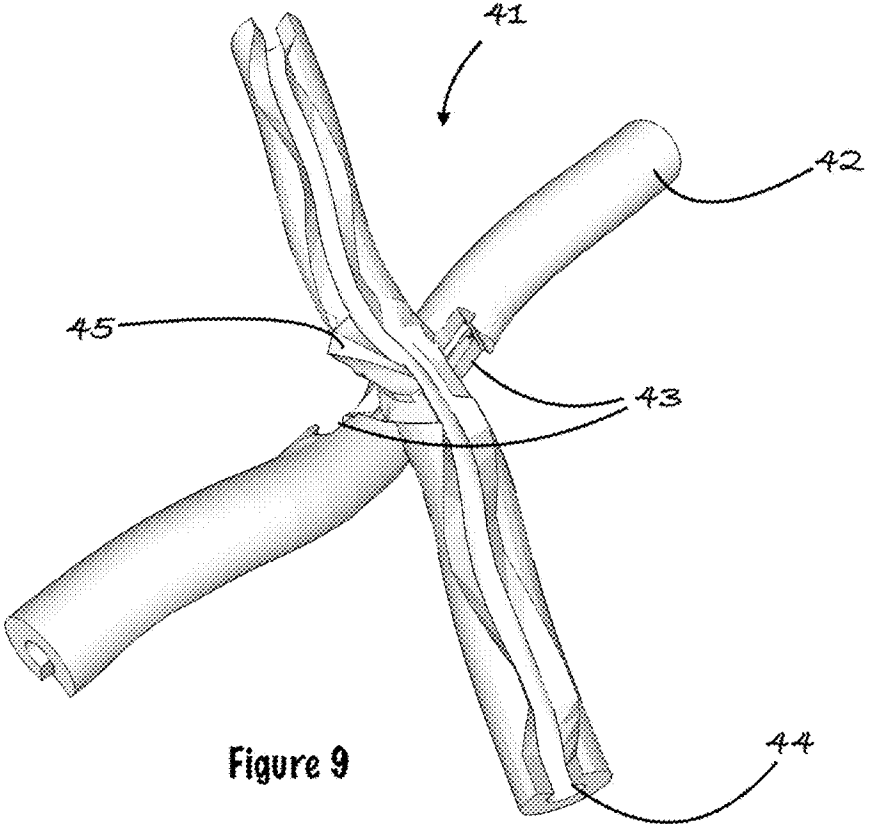
FIG. 9 is a line drawing evidencing a single cross-shaped member with a helical curvature and a c-channel cut axially along each of the four arms.

FIG. 9 shows a single helical cross-shaped member 41 with a c-channel 44 cut along the axis into the each of the helical cross-member arms 42. The figure also shows an interface joint 45 and grooves 43 which allow for the insertion of other like cross-shaped members. The interface joint 45 is the part which receives other like cross-shaped members. All three like members are aligned and set along this axis. The grooves 43 that are notched perpendicularly to the arms 42 of the member so that each groove aligns with a groove of another like member. These grooves are specifically shaped to removably snap into and hold other like members' arms.

FIG. 10 shows and exploded view of the node 40. Such node is comprised of helical three cross-shaped members 41, all of which join at each of the other two joints. These three cross-shaped members are then locked into place utilizing a snap-fit mechanism, whereby light tension is applied to the arms of one member each such snap-fit mechanism embodied in an interlocking groove 43. A helical cross-member ledge 46 located at the edge of each groove to prevent unintentional disengagement of the interlocked members.

Figure 11:
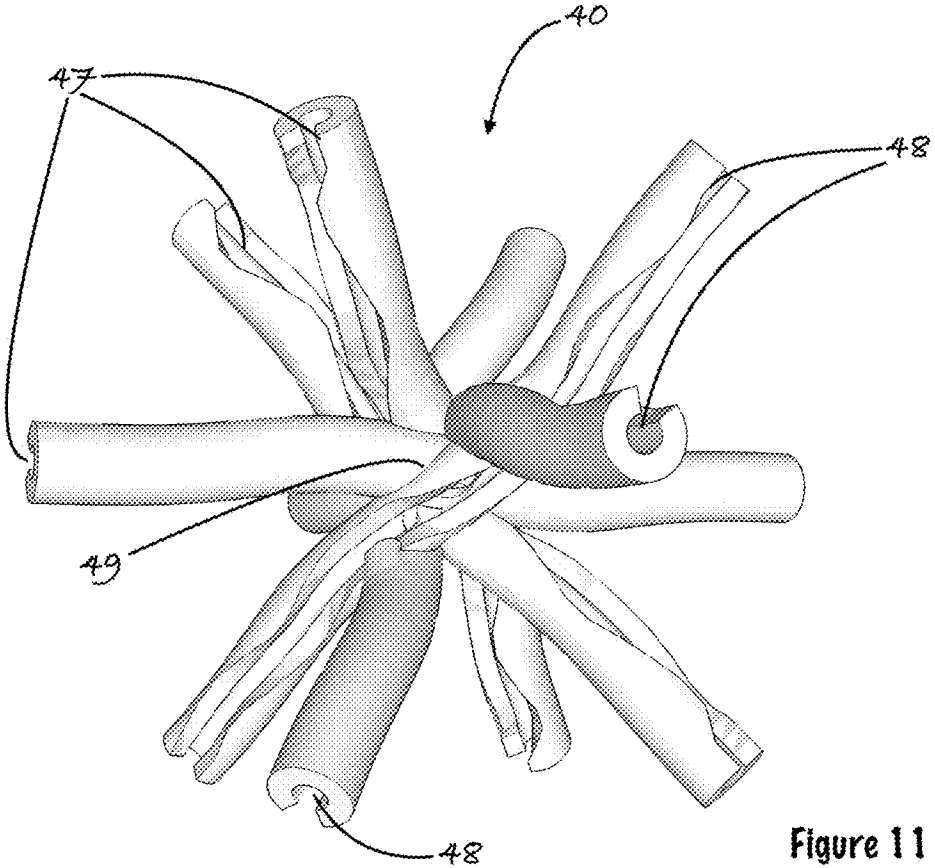
FIG. 11 is a line drawing evidencing the fully-assembled helical curved c-channel node, comprising six c-channels that surround and circumvent a central point.

FIG. 11 shows a fully formed node 40. Each 12-pointed node has six channels, including three inner channels 47 and three outer channels 48, all of which are directionally diverted around one the central point of intersection 49. This node is held together by snap-fit mechanisms, which allow each node to be subsequently taken apart and broken down into its component pieces. However, if necessary, the node can be permanently secured by the use of glues, adhesives or welding.

Figure 12:
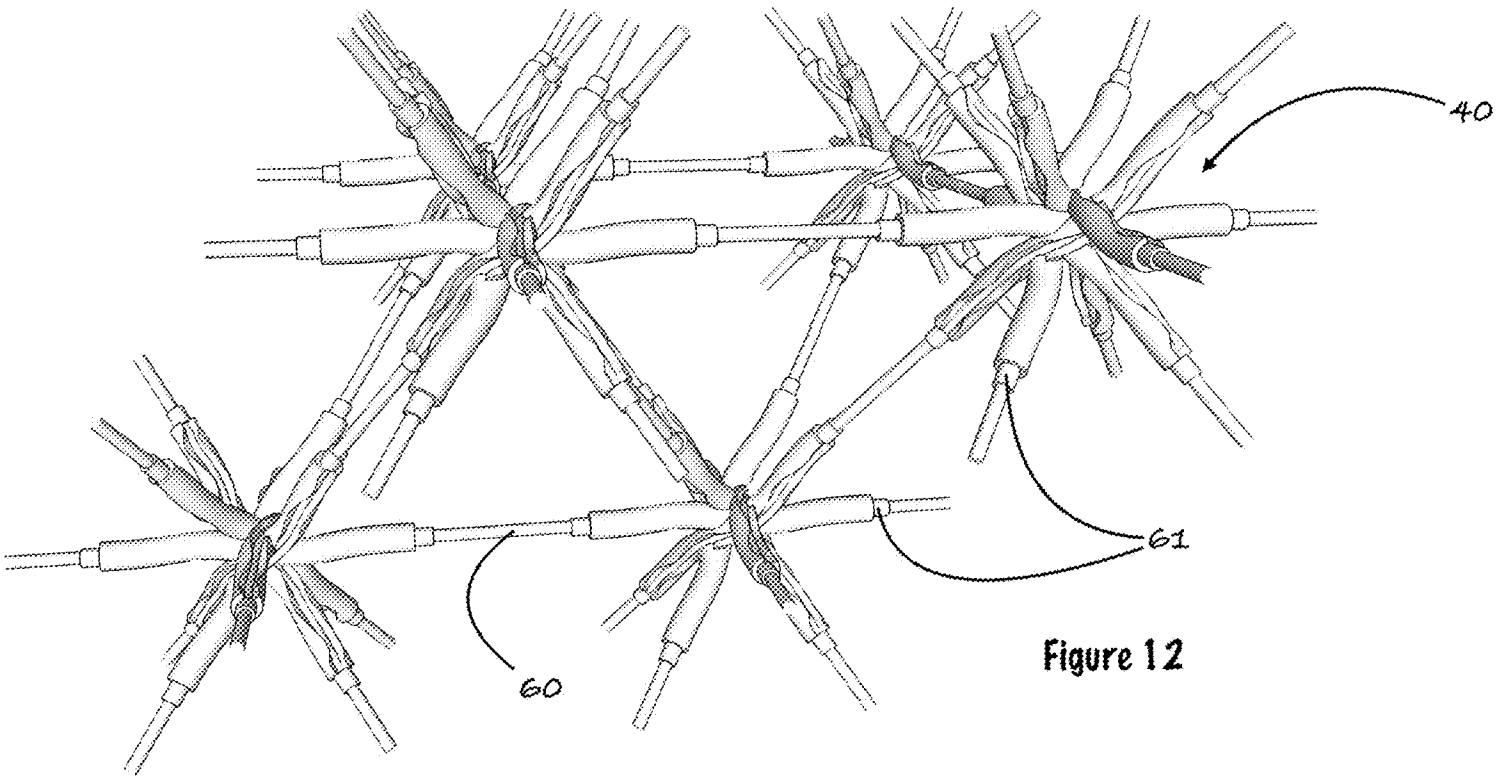
FIG. 12 is a line drawing evidencing six fully-assembled helical curved c-channel nodes with rods emanating from each node to tie into other like nodes.

FIG. 12 shows a set of six nodes 40 along with connecting rods 60 joined together to form a tetrahedral-octahedral honeycomb structure. Each node has a total of six connecting rods running through each of the six channels 47,48. Rods can run the length of the structure and penetrate through several nodes. The gap in the c-channels 44 is significantly smaller than the diameter of the rods. Rods can therefore be pressed and snapped into the channel. Friction prevents the nodes from slipping axially through the nodes.

The twisting curvature of the channels provides significant friction when the rods try to move axially along the channels. This friction thus prevents the movement of the rods axially, however some freedom of axial movement can occur. To fix the rod and prevent any axial movement, two crimping sleeves 61 can be crimped onto the connecting rod 60, one such sleeve at the end of each arm. The use of the crimping sleeves is at the discretion of the designer or engineer, but are not absolutely necessary.

Figure 13:
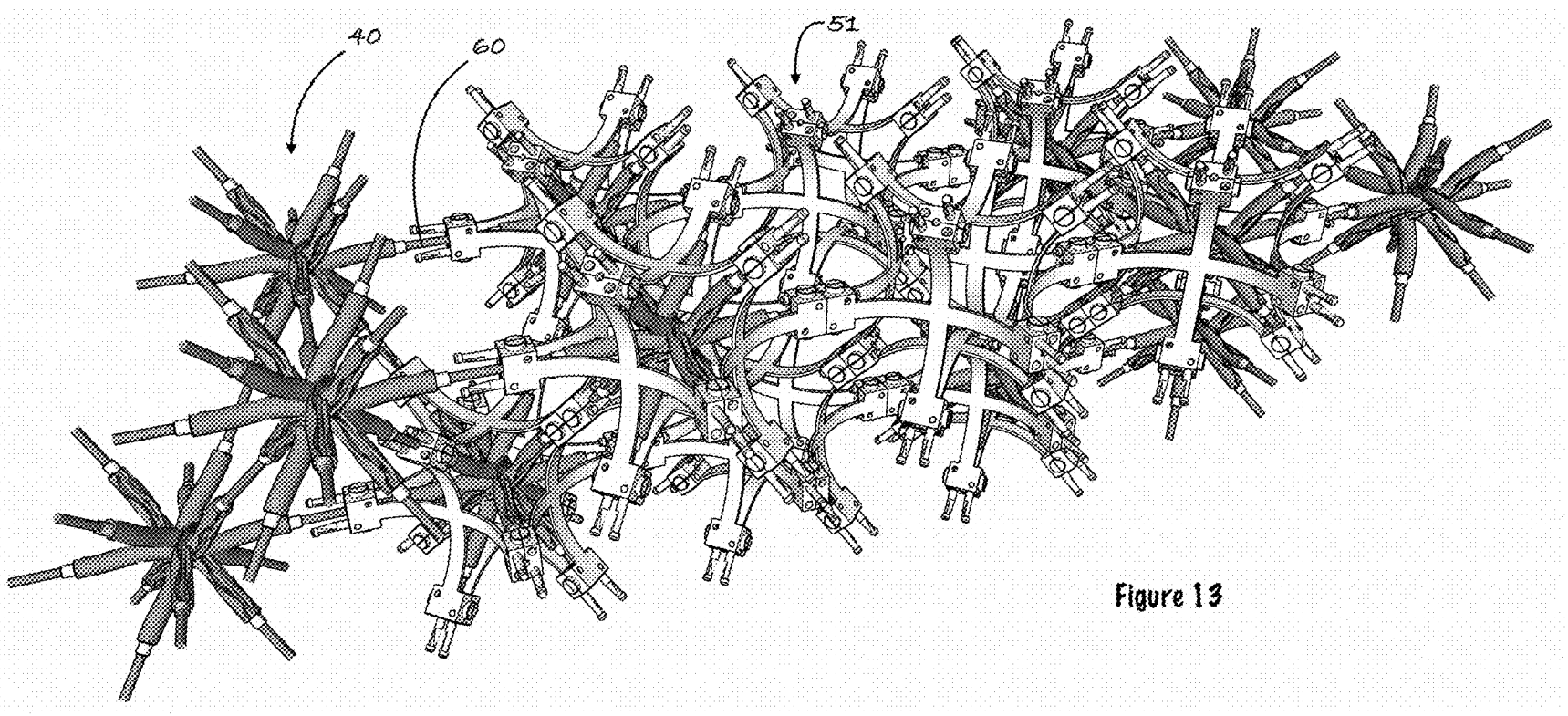
FIG. 13 is a line drawing evidencing one potential frame assembly embodiment utilizing each of the spherical, reverse and helical curved c-channel types of units in concert.

FIG. 13 shows a frame consisting of a plurality of interlocking units as described herein, including spherical units 50, reverse units 51 and connector rod-holding nodes 40.

Figure 14:
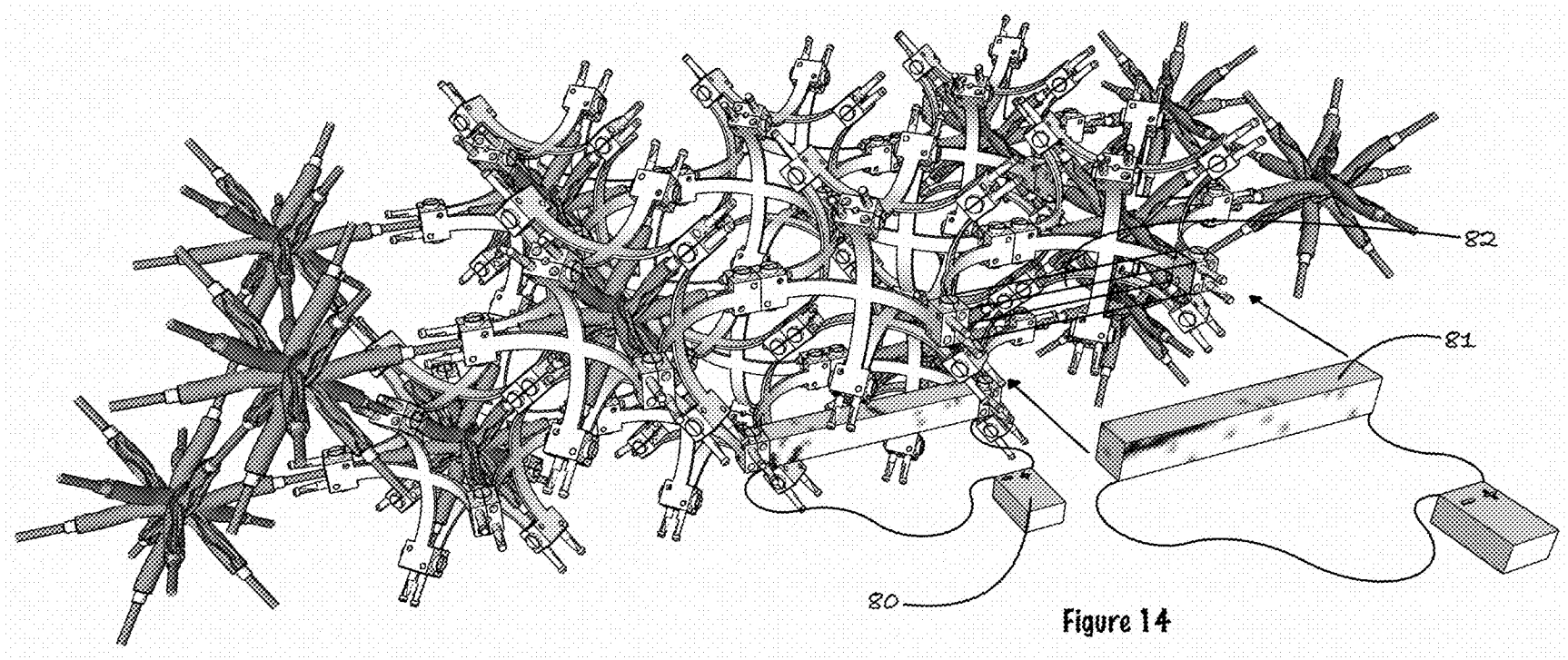
FIG. 14 is a line drawing evidencing the frame of FIG. 13, wherein the frame has one piezo-electric crystal inserted into the frame and another being introduced into the matrix.

FIG. 14 shows the same frame in FIG. 13 along with two piezo-electric crystals. One crystal is installed into the frame, the other is being installed into the frame at a site. In this case, the site is between two adjacent connector piece assemblies 39 and is denoted by a hollow rectangular cuboid. shows an alternate configuration consisting of six interlocking cross-shaped members 20 which, when interconnected, will form a spherical unit 50.

Figure 15:
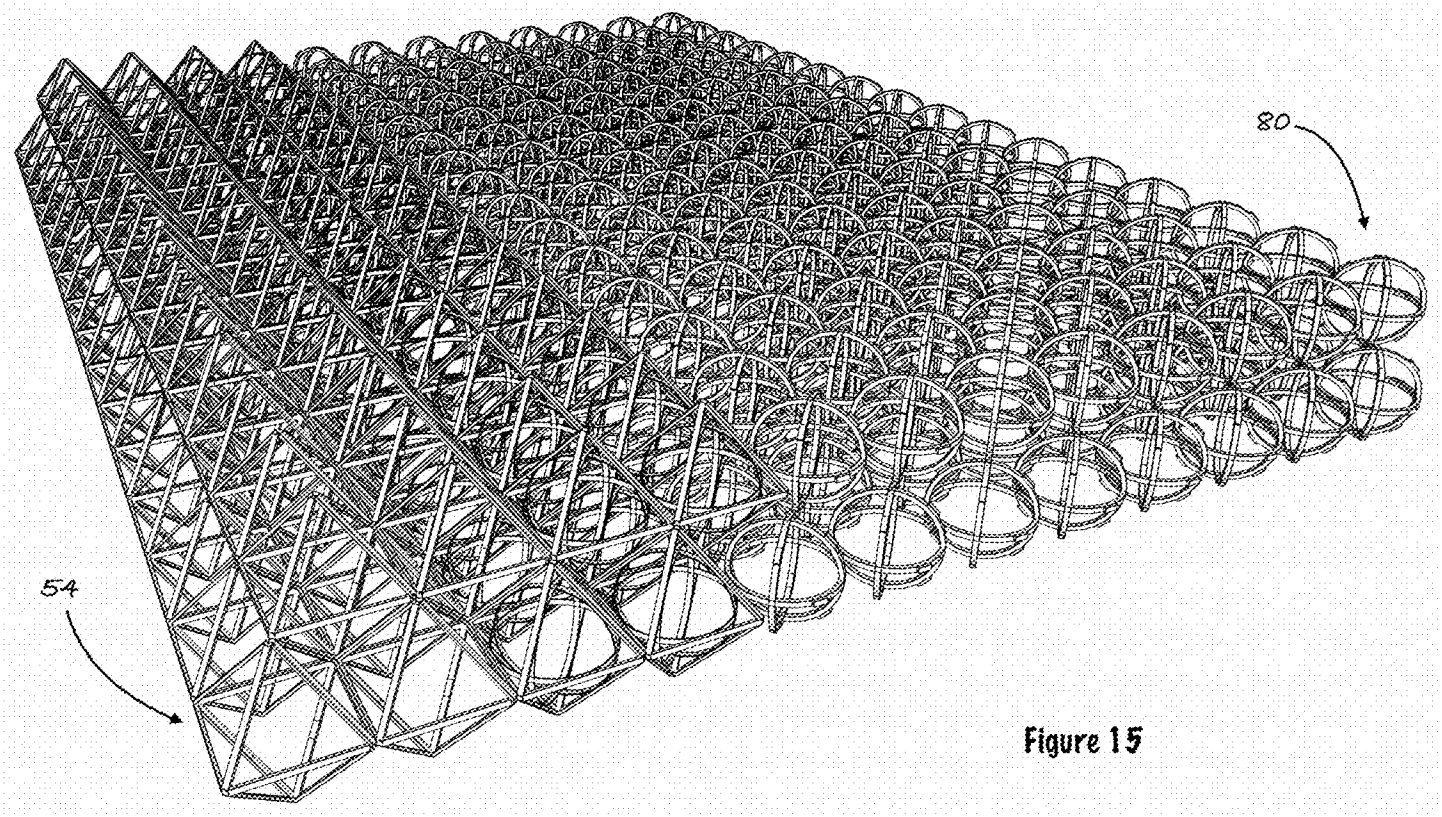
FIG. 15 is a line drawing evidencing an alternate embodiment of frame assembly, utilizing spherical units in combination with the tetrahedral-octahedral honeycomb structure.

FIG. 15 shows an alternate embodiment of a plurality of spherical units 50 arranged within octahedral units 54, forming a honeycombed frame acting as a single structure with properties of both flexibility and rigidity.

LIST OF REFERENCE NUMBERS

10 Frame System
20 Cross-shaped member
21 Arm end
22 Cross piece
23 Arm
30 Connector piece
30*a* proximal surface
30*b* distal surface
30*c* side surfaces
30*d* dorsal face
30*e* ventral face
31 Distal connecting pin
31*a* Ledge
31*b* Angled edge
32 Distal connecting hole
33 Side alignment pin (tall)
34 Side alignment hole (short)
35 Side alignment pin (short)
36 Side alignment hole (tall)
37 Channel
37*a* Rod hole
38 Semicircular protrusion
39 Connector piece assembly
40 Node
41 Helical cross-member
42 Helical cross-member arm
43 Groove
44 C-channel
45 Interface joint
46 Helical cross-member ledge
47 Inner channel
48 Outer channel
49 Point of intersection
50 Spherical unit
51 Reverse unit
52 Open-topped spherical unit
52*a* Open top
53 Starburst unit
54 Octahedral unit
60 Connector rod
61 Crimping sleeve
70 overlocking block The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A node for constructing a space frame, such node comprising two or more helical cross-shaped members, each such member with four arms, wherein each such member comprises one or more radial interlocking grooves allowing two or more such members to be reversibly interlocked at an interface joint by snap-fit attachment and each arm comprises a channel cut along or through an axis, each arm thus accommodating a rod for connecting the node to other nodes.

2. The node of claim 1, comprising twelve total arms and thereby twelve points of attachment to other nodes.

3. The node of claim 1, whereby each cross-shaped member is composed of a material selected from the group consisting of shape memory alloys, shape memory polymers and shape memory copolymers.

4. The node of claim 1, whereby each cross-shaped member is permanently attached using melting, adhesives or similar bonding.

5. A node for constructing a space frame, such node comprising six flexible arms, wherein each flexible arm has two ends and bends or twists around a central point to form a first and second skew-divergent pattern, wherein the first skew-divergent pattern fits inside the second skew-divergent pattern, wherein each arm comprises a cylindrical channel cut along or through an axis, wherein the arms are made of a semi-flexible material and each arm comprises one or more radial interlocking grooves and the interlocking grooves align for snap-fit attachment.

* * * * *